US006811233B1

(12) United States Patent
Packer

(10) Patent No.: US 6,811,233 B1
(45) Date of Patent: Nov. 2, 2004

(54) FOLDABLE WORKSTATION AND SHELVING SYSTEM

(75) Inventor: Stephen R. Packer, Las Vegas, NV (US)

(73) Assignee: CanAm Marketing Corporation, Las Vegas, NV (US)

( * ) Notice: Subject to any disclaimer, the term of this patent is extended or adjusted under 35 U.S.C. 154(b) by 36 days.

(21) Appl. No.: 10/301,031

(22) Filed: Nov. 20, 2002

Related U.S. Application Data

(63) Continuation-in-part of application No. 09/827,546, filed on Apr. 6, 2001, now abandoned.

(51) Int. Cl.[7] ..... A47B 77/10
(52) U.S. Cl. ..... 312/313; 108/176; 211/149
(58) Field of Search ..... 312/310, 313, 312/314, 315, 316, 317.1, 317.2, 317.3; 108/6, 94, 99, 115, 48, 92, 142, 176; 211/149, 150, 118, 134, 201

(56) References Cited

U.S. PATENT DOCUMENTS

| | | | | | |
|---|---|---|---|---|---|
| 945,280 | A | | 1/1910 | Lindberg | |
| 968,920 | A | | 8/1910 | Campbell | |
| 1,727,048 | A | | 9/1929 | Cady | |
| 1,758,726 | A | | 5/1930 | Webb | |
| 1,986,078 | A | * | 1/1935 | Spang | 108/176 |
| D95,043 | S | | 4/1935 | Kent | |
| 2,903,318 | A | | 9/1959 | Brockway | 312/304 |
| 2,908,397 | A | | 10/1959 | Patterson | 211/93 |
| 3,025,970 | A | * | 3/1962 | Ostrom | 108/96 |
| 3,151,576 | A | | 10/1964 | Patterson | 108/2 |
| 3,543,890 | A | * | 12/1970 | Criswell | 190/12 R |
| D225,803 | S | | 1/1973 | Moore | D6/130 |
| 4,155,609 | A | | 5/1979 | Skafte et al. | 312/245 |
| 5,085,608 | A | | 2/1992 | Turner | 446/75 |
| 5,408,936 | A | | 4/1995 | Tseng | 108/42 |
| 5,505,318 | A | * | 4/1996 | Goff | 211/90.03 |
| 5,577,622 | A | | 11/1996 | Kapteyn | 211/132 |
| 5,775,034 | A | * | 7/1998 | Logue | 52/36.1 |
| 5,899,346 | A | * | 5/1999 | Newkirk | 211/149 |
| D457,027 | S | | 5/2002 | Müller et al. | D6/574 |

FOREIGN PATENT DOCUMENTS

| | | | | |
|---|---|---|---|---|
| DK | 29161 | * | 7/1910 | 312/315 |
| WO | WO 91/11130 | | 8/1991 | |

* cited by examiner

*Primary Examiner*—John O. Hansen
(74) *Attorney, Agent, or Firm*—Rob L. Phillips; Quirk & Tratos

(57) ABSTRACT

A foldable workbench provides ergonomic and flat horizontal working surfaces that can be folded vertically to occupy less space when desired. The top shelf may fold downwardly and provide a working space for arms and shoulders. The middle space is generally disposed at waist or hip height to provide arm and shoulder space while also providing an object against which a person might lean in order to provide stability, steady themselves, and work upon objects present on the middle shelf. The lower shelf has room for a person's shins or feet, especially when leaning against the middle shelf. The foldable workstation has a generally thin profile when folded up against a wall or other similar vertical support. The folded panels of the foldable workbench provide protection for tools hanging vertically on a pegboard or the like adjacent the upper folded panel. Similarly, foldable shelves provide horizontal storage or stowage space when needed yet fold vertically to occupy less space when so desired.

15 Claims, 7 Drawing Sheets

FOLDABLE WORKSTATION AND SHELVING SYSTEM

CROSS-REFERENCES TO RELATED APPLICATIONS

This patent application is a continuation-in-part of U.S. patent application Ser. No. 09/827,546 filed Apr. 6, 2001 entitled Foldable Storage Shelves for Shipping Mail and the Like now abandoned, which application is incorporated herein by this reference thereto.

This patent application is related to U.S. Design Pat. Application Ser. No. 29/169,638 filed Oct. 23, 2002 entitled Foldable Workbench and Shelving System which application is incorporated herein by this reference thereto.

This patent application is related to U.S. Provisional Patent Application Serial No. 60/333,517 filed Nov. 21, 2001 entitled Foldable Workbench and Shelving System which application is incorporated herein by this reference thereto.

BACKGROUND OF THE INVENTION

1. Field of the Invention

This invention relates to workstations and shelves and particularly to a folding workstation that has work surfaces foldable against a wall to provide flat working surfaces for space-constrained and other spaces.

2. Description of the Related Art

Workstations and workbenches often have flat horizontal surfaces upon which work may be performed. These horizontal surfaces occupy space, often within the confines of a room or building. The use of this space by the workstation or workbench prevents the use of such space for other purposes. This limits the available space adjacent the workstation even though the workstation may only be used on a temporary or intermittent basis.

The flat surfaces of the workstation provide support for a variety of tasks including food preparation in the food service industry, instrument or other object preparation in a surgical theater, and the like. While it is convenient, useful, and perhaps even critical to have the availability of such flat, supporting work surfaces, such horizontally-projecting surfaces occupy space that might be needed for other purposes or that might be better used or made available once the work surface is no longer needed.

A variety of attempts have been made in the prior art with respect to providing foldable and/or collapsible working surfaces. Such earlier developments of the art include the following patents and disclosures:

U.S. Pat. No. 5,408,936 to Tseng discloses a wall-mounted rack assembly having a foldable table-like plate member with a U-shaped support leg, and a second foldable shelf-like plate member. Such features are shown in some detail in FIG. 3, particularly elements 41, 43 and 51.

U.S. Pat. No. 1,727,048 to Cady discloses an upwardly folding shelf system having multiple pivotable shelves connected to a pair of legs. FIG. 2 shows the folding operation of the folding shelf.

U.S. Pat. No. 5,577,622 to Kapteyn discloses a rack having a plurality of shelves that are able to fold upwardly into a storage position. For example, refer to FIG. 2 (elements 12, 34 and 44) for additional detail. FIG. 2 shows in phantom the folding operation. FIG. 3 shows with phantom item 10 the crib-like holding of boxes for inspection.

U.S. Pat. No. 1,758,726 to Webb discloses a shelf and folding table structure whereby the entire structure may be folded into a non-use position. FIG. 1 (elements 7, 10, 11 and 12) shows more detail regarding operation.

U.S. Pat. No. 3,151,576 to Patterson discloses a foldable display stand having plural shelves that can be maintained in selectable positions by use of fastening bolts. FIG. 2 shows the operation of the shelf trays.

U.S. Pat. No. 945,280 to Lindberg discloses an adjustable shelf bracket that has a removable pin for selectively maintaining the shelf at a desired angle.

Additionally, certain design patents are known for foldable or folding shelf systems and the like. These include:

U.S. Pat. No. Des. 457,027 to Muller et al. is directed to a supported shelf system having struts on either side of the shelf panels.

U.S. Pat. No. Des. 225,803 to Moore is directed to a foldable wall shelving unit which has shelves that fold into a bookcase-like frame with the shelves having depressions or wells into which objects may fit.

U.S. Pat. No. 95,043 to Kent is directed to a parcel shelf with an apparent latching mechanism that allows the shelf to unfold from a vertical framework.

PCT International Application PCT/AU91/00030, Publication No. WO 91/11130 is directed to a wall mountable foldable table. This folding table fits into a vertical framework and, as shown in the drawings, provides means by which an ironing board or similar object can be stowed in such a framework. FIGS. 5 and 6 show a folding mechanism for the foldable table.

As can be seen, a number of approaches and attempts to advance the art have been made with respect to providing collapsible or folding work surfaces. Generally, all of these are directed to specific applications and take into account the generally different operating parameters so as to fulfill the need demanding the solution delivered by the respective patented inventions.

However, the art is generally lacking in collapsible and foldable workstations that take into account the certain differences in physique of the human body. Generally, the multiple workstations of the prior art did not take into account the need for leg or foot room, as well as the ability to use an expansive horizontal work surface in conjunction with a smaller and upper horizontal work surface.

Consequently, the prior art still requires additional foldable workbenches and workstations that more advantageously fulfill the needs demanded by people working in small or confined areas or such areas that only require temporary workspace. While efficient to maximize the available surface area to the person using the workstation, certain considerations must also be made with respect to the area in which the workstation operates so that when the workstation is folded up or collapses, a minimum horizontal area is displaced such that the surface area when the workstation is unfolded as compared to when it is folded or collapsed is maximized.

Industrial applications such as those present in the food service industry where prep work must be done or the like also demand a workstation that is used on a temporary basis. In preparation for lunch or evening meals, a certain amount of work is done in order to prepare items for cooking and/or serving. Once these items are prepared, the flat work surfaces on which such preparations are made may no longer be necessary and the area may be freed up in order to provide space for other purposes such as foot traffic and the like.

Consequently, a need remains in the art for foldable workstations that tailor themselves to certain specific applications or that may have a more general application and fulfill a wide variety of needs. Additionally, the state of the art would be augmented by a flexible and adaptable foldable workstation that provides a variety of uses and applications for foldable workstations that provide horizontal working surfaces and work space. It would be more to advantageous to provide a workbench that only occupied adjacent space when necessary. It would also be advantageous to provide a workbench that provides easy access to and storage of tools.

SUMMARY OF THE INVENTION

In view of the foregoing disadvantages inherent in the known types of foldable or collapsible workstations/workbenches now present in the prior art, the present invention provides a new foldable workstation construction wherein the amount of workstation working surface area is maximized in conjunction with providing conveniently located and disposed working surfaces for people using the foldable workstation.

The general purpose of the present invention, which will be described subsequently in greater detail, is to provide a foldable workstation that accommodates the human form for better use and structure. The foldable workstation described herein has many of the advantages of foldable workstations and benches mentioned heretofore and developed previously as well as many novel features that result in a new foldable workstation which is not anticipated, rendered obvious, suggested, taught, or even implied by any of the prior art foldable shelves, racks, and the like, either alone or in any combination thereof.

The foldable workstation of the present invention provides a foldable workstation that is attachable to a wall that has three flat horizontal work surfaces upon which work may be performed or items temporarily laid. The bottom shelf or surface is offset from upstanding legs that support a middle work surface in order to provide room for a person's shins and/or feet. While this reduces the surface area available for the lower shelf, it enables a person to better engage the workstation as a whole, thereby providing more advantage and utility. The lower shelf is connected by lateral supports to the upstanding legs supporting the middle shelf.

The middle shelf is generally the larger of the flat surfaces and is generally positioned at the height of a person's hips or waist so that it might be more easily engaged or even possibly leaned into, onto, or against by the person.

Lastly, an upper shelf is provided that is available for supporting objects such as bowls, tools, and the like. The upper shelf is the smallest shelf and is generally approximately half the size of the lower shelf. In doing so, the shorter projection outward made by the upper shelf allows more room for a person to maneuver, enabling the arms to function unobstructed while working on items present on the middle shelf.

All three shelves are pivotally connected to a chassis which enables the flat folding of each of the work surfaces against a wall or other vertical support upon which the chassis is affixed. Generally, the middle and lower work surfaces fold up toward the chassis while the upper smaller work surface folds down into the chassis.

The table may be made of stainless steel or surgical steel for easy cleaning and sterilization, making it especially advantageous for the food service industry and medical professions.

The present invention provides a folding or foldable workstation that allows flat horizontal workspaces to be provided as needed. The foldable workstation of the present invention also allows the retraction or folding of the flat work surface against a wall or the like to enable the foldable workbench to occupy less space when not in use.

OBJECTS OF THE INVENTION

It is an object of the present invention to provide a foldable workstation that accommodates the human form.

It is another object of the present invention to provide a foldable workstation that efficiently uses space available, providing a small profile when folded or collapsed, yet providing ample workspace when unfolded.

It is an object of the present invention to provide a foldable workstation that may be sterilized for use in the food service or medical areas.

It is an object of the present invention to provide a foldable workbench.

It is another object of the present invention to provide foldable horizontal work and storage spaces.

These and other objects and advantages of the present invention will be apparent from a review of the following specification and accompanying drawings.

DESCRIPTION OF THE PREFERRED EMBODIMENT(S)

Figure 1:
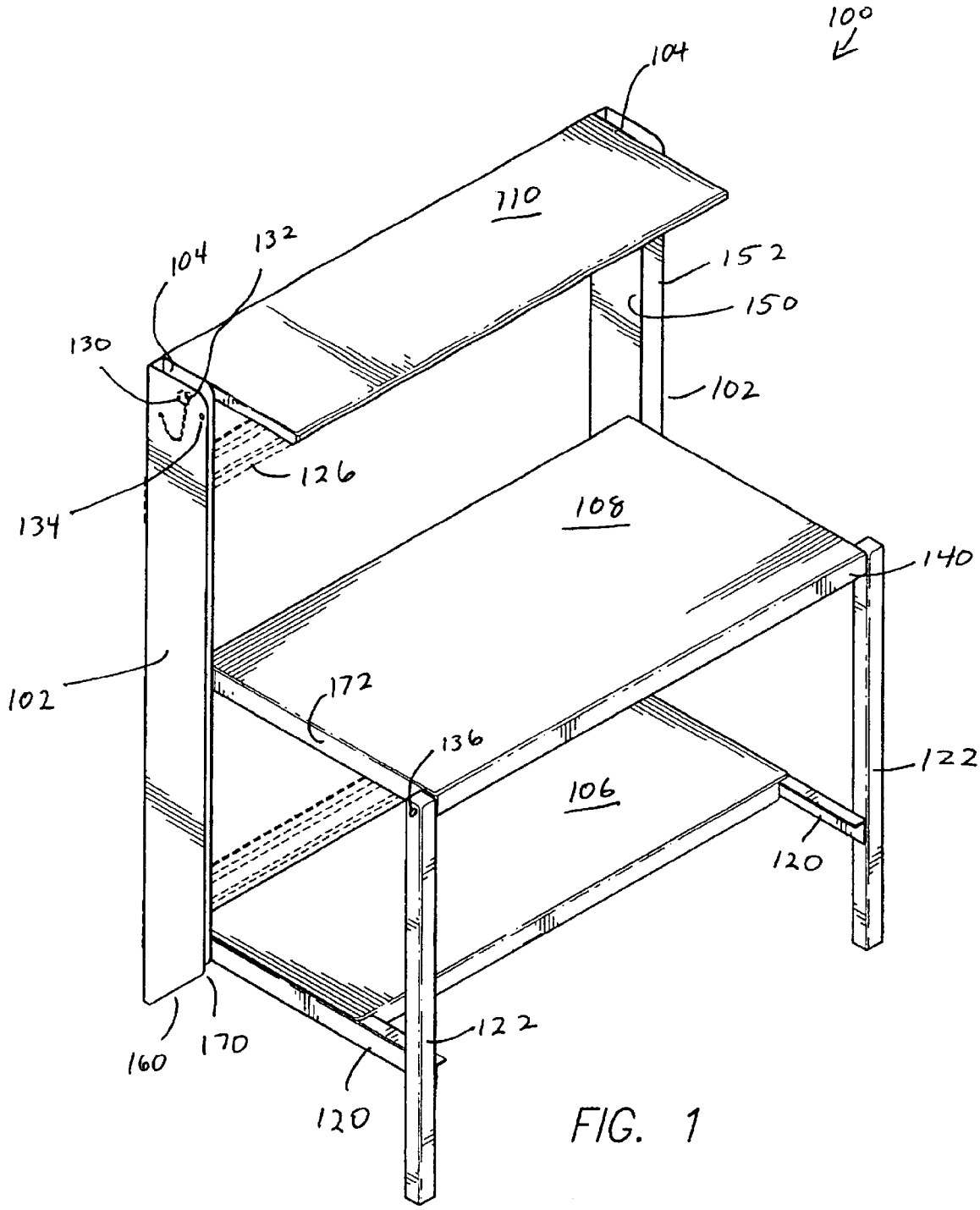
FIG. 1 is a right side front perspective view of a preferred embodiment of the foldable workstation of the present invention. A pin for use in holding up the top shelf as well as a chain attached thereto are shown in phantom as is lateral bracing.
Figure 2:
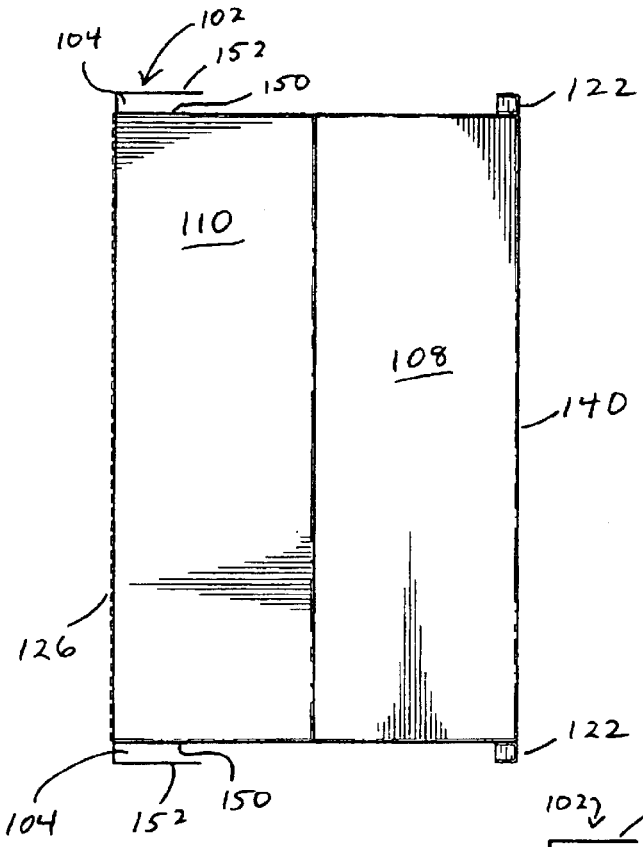
FIG. 2 is a top plan view of the foldable workstation shown in FIG. 1. Lateral bracing is shown in phantom.
Figure 3:
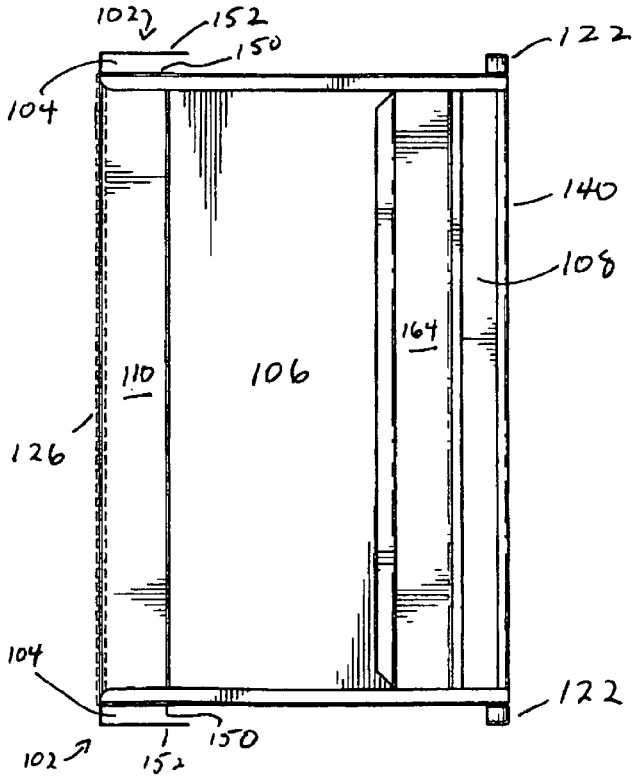
FIG. 3 is a bottom plan view of the foldable workstation shown in FIG. 1. Lateral bracing is shown in phantom.
Figure 5:
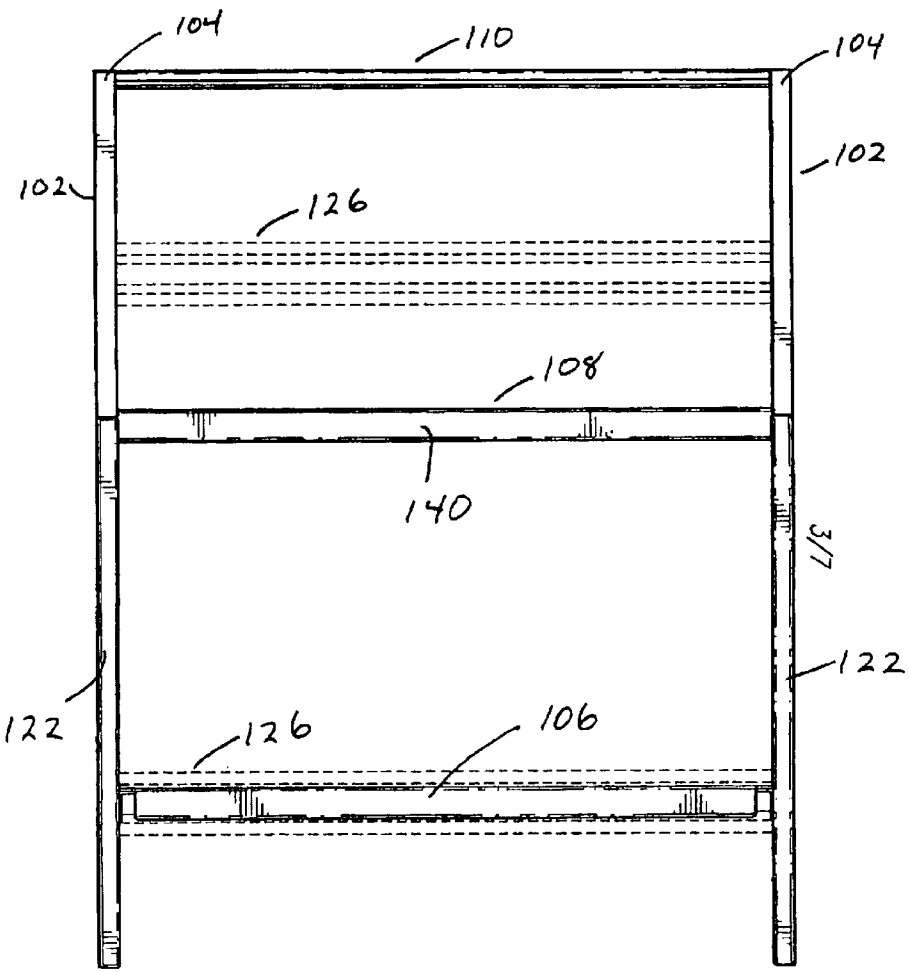
FIG. 5 is a front elevational view of the foldable workstation of FIG. 1. Lateral bracing is shown in phantom.
Figure 4:
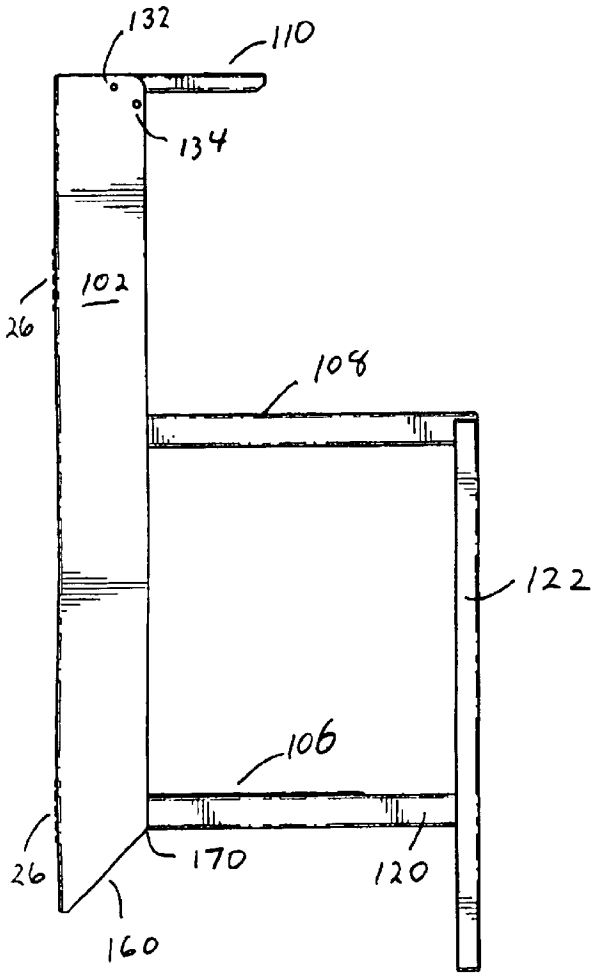
FIG. 4 is a right side elevational view of the foldable workstation of FIG. 1. Lateral bracing is shown in phantom.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the drawing where like numerals of reference indicate like elements throughout it will be noted that the present invention is used in the context of being attached to an ultimate support, such as a wall or other vertical flat surface, or other vertical support such as upstanding poles or rails that provide support for the foldable work station 100 of the present invention.

As shown in FIG. 1, the foldable workstation 100 of the present invention has oppositely opposed and generally parallel upstanding frame shields 102 that serve as supports for the working surfaces of the foldable workstation 100. Upstanding frame shields are generally U-shaped in configuration, having a central slot 104 about which more detail is given below.

The lower shelf 106, middle shelf 108, and upper shelf 110 are generally all pivotally connected to the upstanding frame shields 102. The three shelves pivot on axes that are all generally parallel to one another. The lower shelf 106 may be connected to the upstanding frame shield by two lower lateral supports 120, which extend beyond the lower shelf to attach to the upstanding legs 122. The upstanding legs 122 are pivotally attached to both the lower lateral supports 120 at the distal end of the lower lateral supports 120, as well as to the free end of the middle shelf 108.

As shown in phantom in FIG. 1 and the other drawings, rear lateral bracing 126 may be optionally present in order to space apart the upstanding frame shields 102. The lateral bracing 126 also provides additional support and may be used as a means of attachment for the foldable workstation 100 to the wall or other ultimate support.

Additionally, one or more pins 130 may be used to secure the upper shelf 110 into place in its horizontal position by engaging a hole therein. Such pins 130 may also hold the upstanding legs 122 into place with respect to the upstanding frame shields 102, as shown in FIGS. 6–10. A first hole 132 in the frame shields 102 may serve to allow passage of the pin 130 through the frame shield gap 104 to engage the upper shelf 110. A second hole 134 may serve to uphold the upstanding legs 122 into place when the middle and lower shelves 108, 106 are folded into the space between the frame shields 102. The corresponding hole 136 may be present in the side of each upstanding leg 122 near the top thereof to provide access for the pin 130.

Due to the unique configuration of the foldable workstation 100, and as shown in FIGS. 6–10, the foldable workstation of the present invention folds into the space between the frame shields 102 in a generally flush fashion in order to provide a minimum profile projecting out from the wall or other ultimate support. Additionally, the forward end 140 of the middle and main shelf 108 rests generally flush with the top of the upstanding frame shields 102, making efficient use of the space used thereby. The same is generally true with respect to the front end of the lower shelf 142. Although it may be fashioned flush with the rear end of the middle shelf, the front end 142 of the lower shelf 106 may also be separated from the rear end of the middle shelf 108 when the two shelves are folded.

Depending upon the need for foot or shin space, the lower shelf may extend towards or retract from the upstanding legs 122 or, alternatively, a center portion of the lower shelf 106 may be removed in order to provide leg space while the side areas of the lower shelf 106 extend towards the upstanding legs 122. Additionally, a number of alternative embodiments may be achieved through propitious construction of the lower shelf 106.

Figure 6:
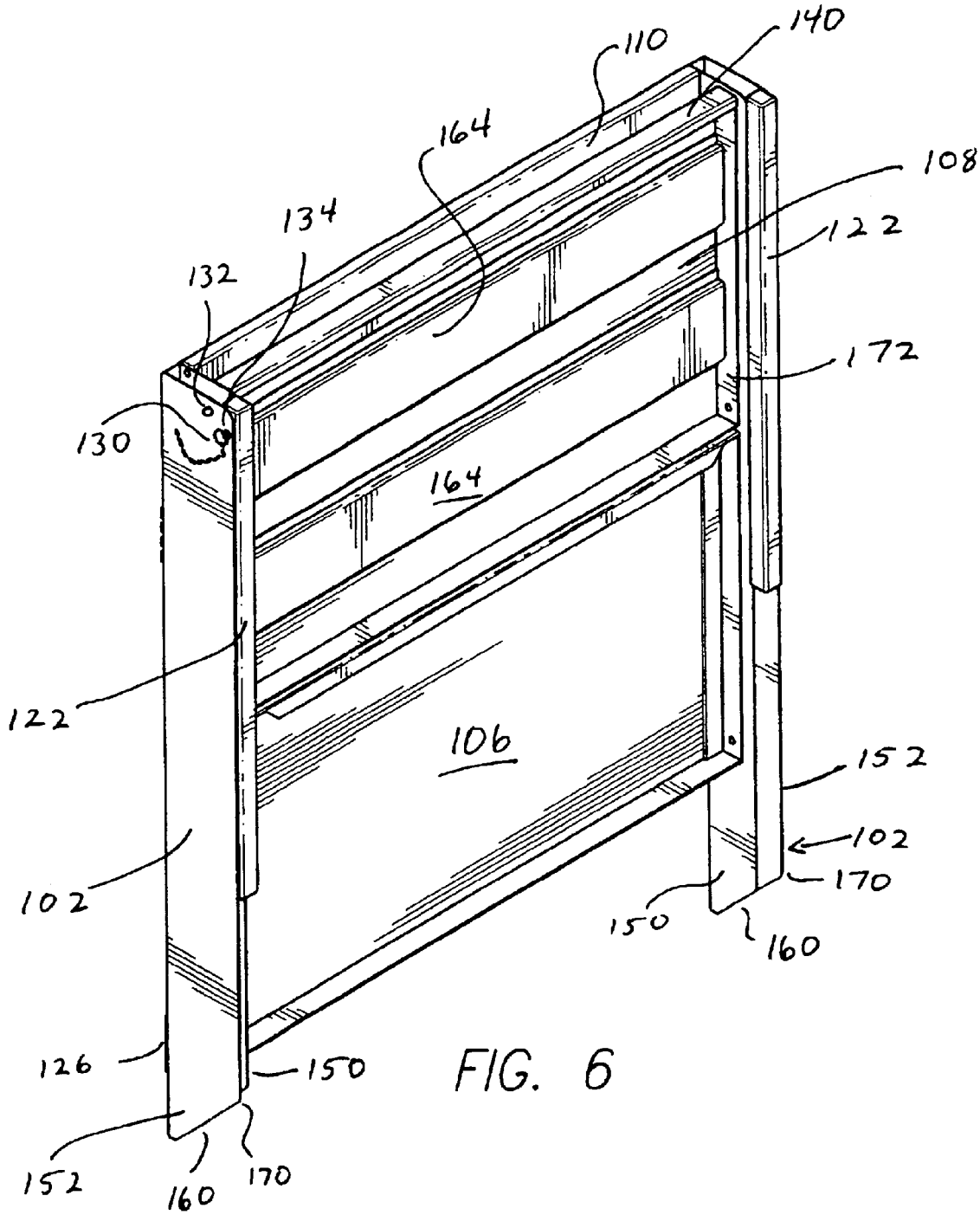
FIG. 6 is a right front perspective view of the foldable workstation shown in a folded configuration.
Figure 7:
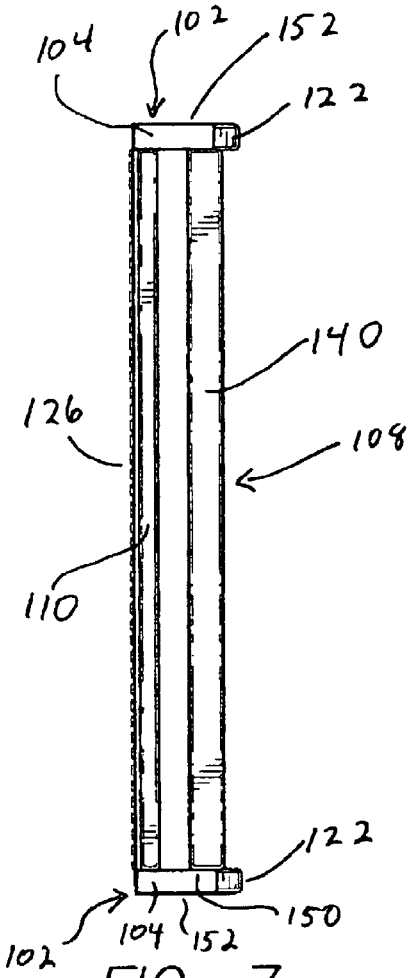
FIG. 7 is a bottom plan view of the folded foldable workstation in FIG. 6. Lateral bracing is shown in phantom.
Figure 8:
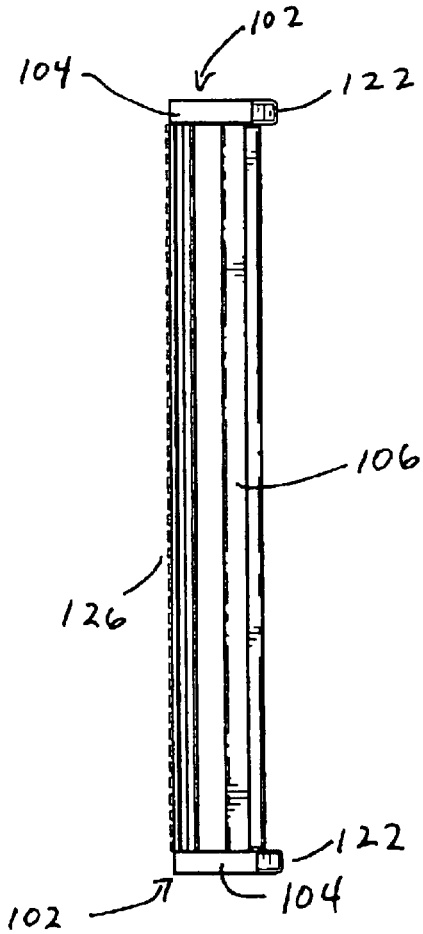
FIG. 8 is a top plan view of the folded foldable workstation shown in FIG. 6. Lateral bracing is shown in phantom.
Figure 10:
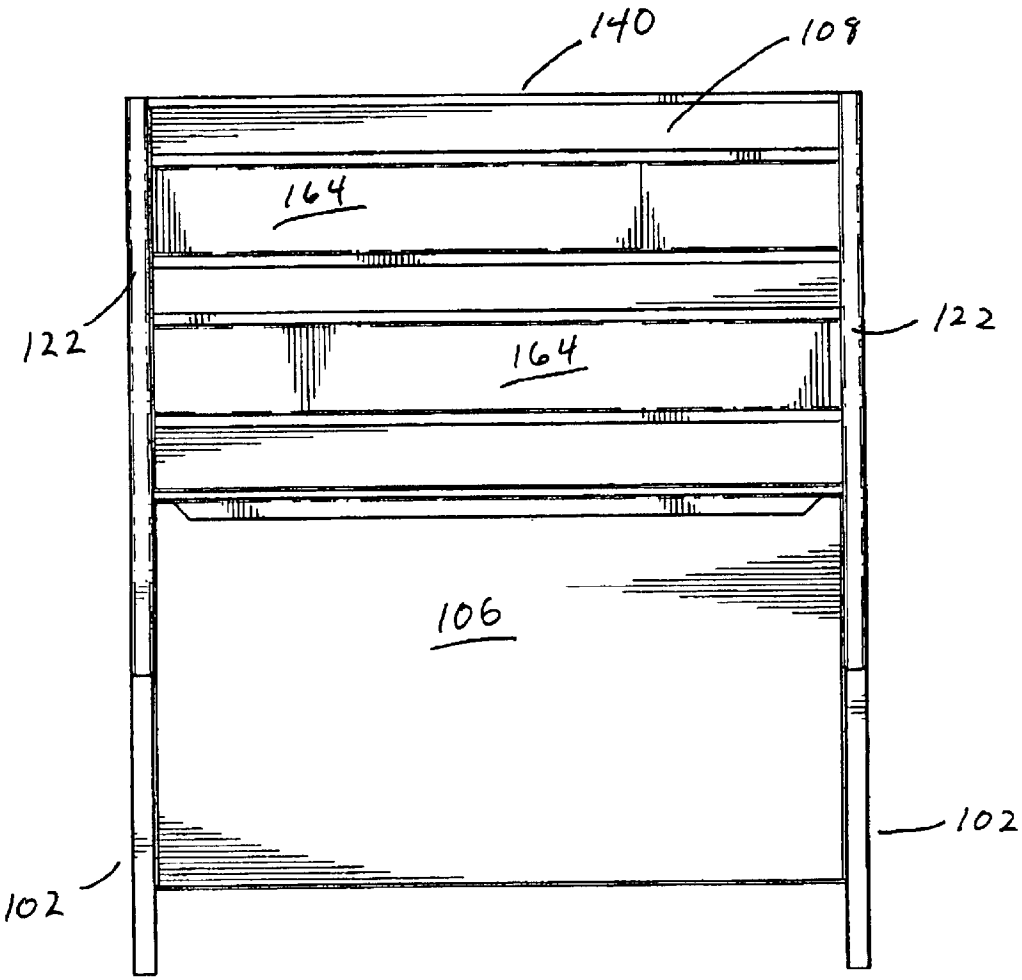
FIG. 10 is a front elevational view of the folded foldable workstation of FIG. 6.
Figure 9:
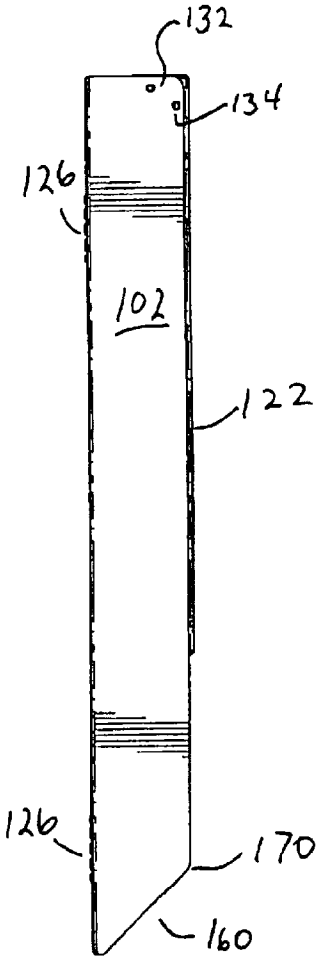
FIG. 9 is a right side elevational view of the folded foldable workstation of FIG. 6. Lateral bracing is shown in phantom.
Figure 11:
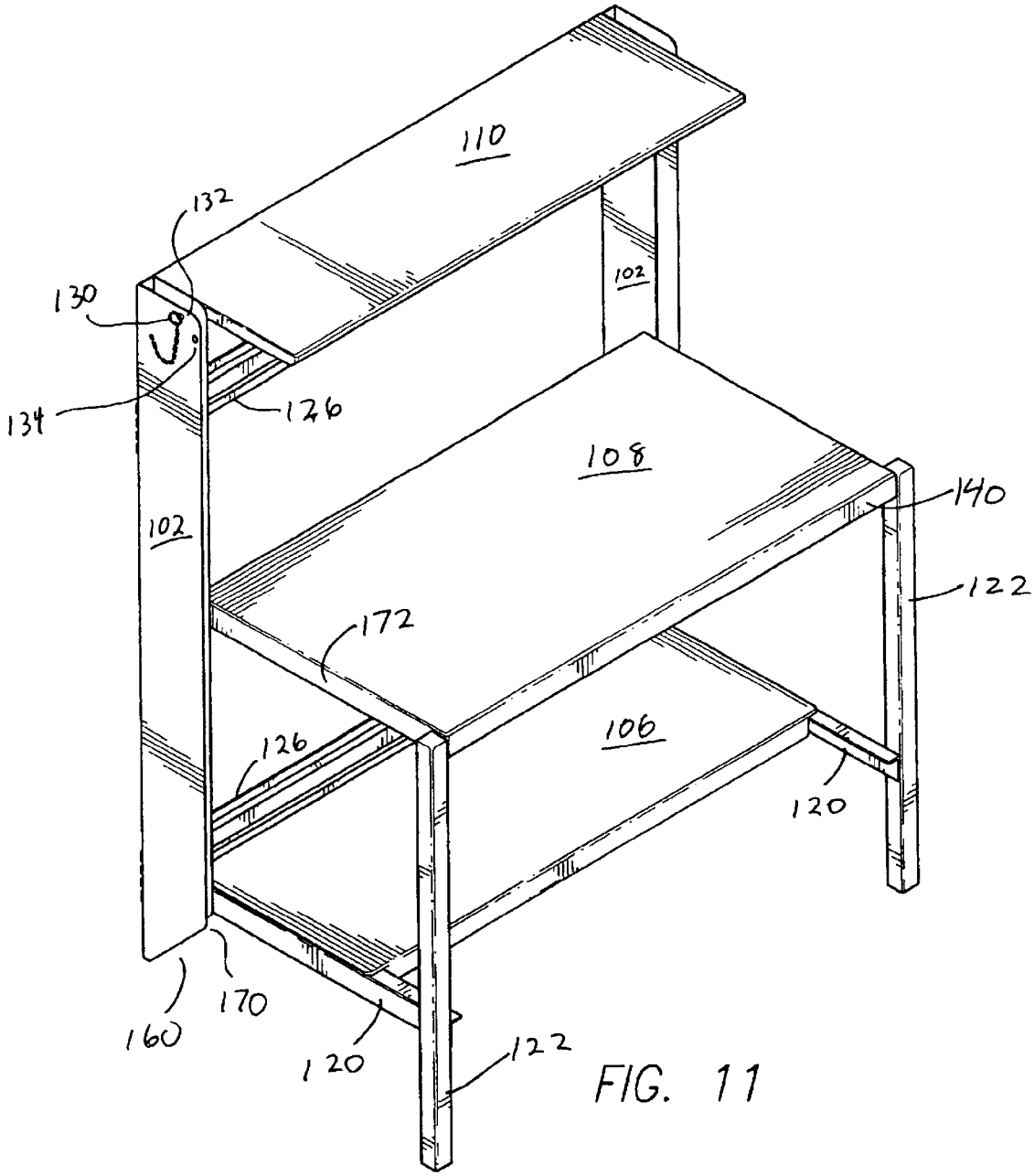
FIG. 11 is a right side front perspective view of the foldable workstation of FIG. 1 including the lateral bracing.

In folding up towards the frame shields 102, the upper and lower shelves 108, 106 may somewhat dispose the upstanding legs 122 at an angle. This slight angle is due to the disposition between the two shelves and their pivotal arrangement with the frame shields 102. Additionally, the inner panel 150 of the frame shields 102 may project outwardly to a smaller degree and a lesser extent than the outer panel 152 in order to accommodate the upstanding legs 122. Generally, the upstanding legs 122 as shown in FIG. 6 do not project out past the outer panel 152 in a preferred embodiment and may come to rest between the two frame shield panels 150, 152.

This provides for a diminished profile for the foldable workstation 100 in its folded configuration. This is a unique aspect of the foldable workstation 100 of the present invention, as the manifestation of such a minimal profile with significant available horizontal workspace surface area delivers unique advantages coupled with the ergonomic designs allowing for foot room for the lower shelf 106 as well as arm and shoulder room for the upper shelf 110. Particularly with limited wall space, the foldable workstation 100 can be configured to accommodate any width of wall space such that a thin foldable workstation or even square foldable workstation could be used for corners while a longer foldable workstation could be used when space so allows. Generally, the distance between the front end of the middle shelf 140 and the frame shields 102 and/or the lateral bracing 126 (when the foldable workstation 100 is unfolded) is generally that of a person's reach because the foldable workstation 100 is meant to accommodate the workings of the human body and the like. Consequently, the general width of the foldable workstation 100, as indicated by the distance between the upstanding legs 122, may be variable and adapted to specific applications.

Ergonomic design is also present in the distance the upper shelf 110 extends outwardly from the wall or rear of the foldable workstation. The upper shelf 110 is designed to enable clear and free working of a person's hands, arms, and shoulders such that the upper shelf 110 does not interfere with turning, moving, and preparing or working upon items resting upon the middle shelf 108. Consequently, the foldable workstation 100 set forth herein provides distinct advantages over those in the prior art, as it accommodates working situations not previously addressed.

Additionally, the upstanding frame shields 102 are generally slanted and not squared at their lower ends 160 as shown in FIGS. 1, 4, 6 and 9. This provides certain manufacturing advantages as otherwise unneeded material is not used. Additionally, an abrupt and sharp corner 170 is avoided such that the projecting corner present the lower end of the frame shields 102 provides a softer angle that is less disposed to causing injury as a right angle squared-off corner would be.

In order to provide additional support for the middle shelf 108, reinforcing supports 164 may be present below and underneath the middle shelf 108. Such reinforcing supports may take the form of bars, hollow half girder structures, or the like extending laterally below the middle shelf 108. As shown in FIG. 6, these supports are generally welded into the down turned sides 172 of the middle shelf 108 and are shaped in the form of a broad U-shape such that a conveniently-manufactured means is provided by which the otherwise possibly thin and flexible upper shelf 108 work surface can be reinforced so that heavier items may be placed upon the middle shelf 108 and adequately supported thereby.

As shown in FIG. 6, when the foldable workstation 100 is folded into its folded configuration, the pin 130 may engage the associated upstanding leg 122 via the upstanding leg hole 134, passing through the associated frame shield 102.

As also shown in FIG. 6, both the middle shelf 108 and lower shelf 106 may have handle-like front ends 140, 142 so that the foldable workstation 100 is more easily grasped and set into its folded configuration. In so doing, the pins 130 are disengaged from the upper shelf 110, which is then folded downwardly into the space between the frame shields 102. The middle and lower shelves 108 are then folded also into the frame shields 102 as the pivotal connections between the middle and lower shelves 108, 106 and their corresponding pivotal connections with the upstanding legs 122 and the frame shields 102 form a parallelogram enabling the upstanding legs 122 to travel towards the frame shields 102 when the middle and lower shelves 108, 106 are pivoted upwardly.

In a preferred embodiment, the foldable workstation 100 is constructed of stainless steel or other sterilizable material. This makes the foldable workstation 100 particularly advantageous in the preparation of food as foodstuffs may come into contact with the working surfaces 106, 108, 110 and such surfaces may be sterilized easily by harsh chemicals or other means. The same is similarly true for use of the foldable workstation 100 in the medical profession. Surgical instruments and the like may come into contact with the sterilized working surfaces 106, 108, 110, yet the foldable workstation 100 folds towards the wall in order to reduce its footprint, making preparation tasks and duties in the surgical theater otherwise simpler, easier and safe.

In an alternative embodiment, a pegboard may be used between the upper shelf 110 and the middle shelf 108 to which tools may be attached as with pegs or the like. Such a pegboard may be disposed between the frame shields 102 and sufficient room may be possible to allow the presence of such tools, even though the foldable workstation 100 is placed into a folded configuration. Alternatively, an indentation or well in the wall supporting the unit may serve to support the pegboard and accompanying tools.

In order to accommodate the lower and upper shelves 106, 108, the pivotal connection of these parts may be placed forward of the rear of the frame shields 102. This allows room for the upper shelf 110 to fold down and behind the middle shelf 108. The upper shelf 110 is generally pivotally connected to the upstanding frame shields 102 and a rear portion thereof, generally at the top of the frame shields 102.

The foldable workstation 100 may also be made of steel as well as stainless steel. Alternative embodiments include the external application of corrosion resistant materials or the construction by corrosion resistant materials so that the foldable workstation may be both strong and durable. Pinch points present in the foldable workstation 100 may be reduced and fasteners for the foldable workstation 100, such as those used to attach the unit to a wall or to provide pivotal connection between the different parts, may be those that are now known in the art or developed in the future. The foldable workstation 100 may be constructed such that the middle shelf 108 may safely hold 230 pounds. The lower and upper shelves 106, 110 may likewise be constructed to hold similar weights for their sizes. Where sterilization is not necessary, the components of foldable workstation 100 may have a powder coated finish. In one embodiment, the foldable workstation 100 may be approximately 49 inches wide, 27 inches deep and 60 inches high when fully extended and weigh approximately 70 pounds. In its closed or folded configuration, such a foldable workstation 100 would have a width of approximately 49 inches, a depth of approximately 5½ inches and a height of approximately 60 inches. As indicated above, the foldable workstation folds easily against the wall when not in use and may install easily in approximately half an hour. When sent or transported to the ultimate user, some assembly may be required, but generally none that would require special tools or special knowledge in the art.

Any person or organization that needs to maximize the utilization of space may find the foldable workstation 100 a significant addition to their infrastructure. Such users may include hotels, motels, hospitals, factories and warehouses, offices, retail stores, auto repair shops, delivery companies, gyms, libraries, laboratories, and fire and police stations, to name but a few. Additional applications of the foldable workstation 100 include use in loading docks, in both staging and receiving areas, will-call areas, as attachments to pallet racks and end caps, janitorial closets, garages, mail rooms, kitchens and other food preparation areas, restaurant busboy stations, locker rooms, laundry rooms, storage areas, cleaning rooms, retail displays, maintenance engineering departments, delivery vans and trucks, or any other place where the utilization of space in an efficient manner is important.

As shown in the several Figures, the elements providing utility and novelty to the present invention include the ability of flat working surfaces to fold flat as against a wall. For the folding shelves shown in the figures, a number of flat working shelf surfaces are provided. The depth of the shelves or other flat surfaces coupled with the distance between such flat surfaces affects the ability of the flat surfaces to fold flat against a wall or other vertical structure.

By providing horizontal working space in a manner that folds flat vertically, the foldable workbench and foldable shelf system of the present invention enable people to rely upon the flat working surfaces when needed yet allow such surfaces to occupy less space when not needed.

While the present invention has been described with regards to particular embodiments, it is recognized that additional variations of the present invention may be devised without departing from the inventive concept.

What is claimed is:

1. A foldable workstation providing generally flat and horizontal work surfaces that may be collapsed to reduce the size of the foldable workstation, comprising:

a pair of oppositely opposed vertical supports in spaced-apart relation;

an upper shelf pivotally coupled to said vertical supports;

a middle shelf pivotally coupled to said vertical supports at a rear end of said middle shelf;

a lower shelf pivotally coupled to said vertical supports at a rear end of said lower shelf;

a pair of upstanding legs pivotally coupled to said middle and lower shelves at front ends of said middle and lower shelves;

said middle shelf positionable between said upper shelf and lower shelf;

said lower shelf extending away from said vertical supports a distance less than that of said middle shelf to accommodate a person's feet and shins and said lower shelf further coupled to said pair of upstanding legs by a pair of oppositely opposed and spaced apart lateral supports coupled to said lower shelf on opposite sides thereof, said lateral supports pivotally coupled to said upstanding legs and pivotally coupled to said vertical supports; and said upper shelf extending away from said vertical supports a distance less than that of said middle shelf to accommodate a person's arms and shoulders; and whereby the folding workstation provides collapsible work and storage surfaces that accommodate a person's anatomy and allows a person to perform tasks using the folding workstation with reduced interference and obstruction.

2. A foldable workstation providing generally flat and horizontal work surfaces that may be collapsed to reduce the size of the foldable workstation as set forth in claim 1, wherein said vertical supports further comprise:

upstanding frame shields that support and protect said upper, middle, and lower shelves when said shelves are in a collapsed configuration.

3. A foldable workstation providing generally flat and horizontal work surfaces that may be collapsed to reduce the size of the foldable workstation as set forth in claim 2, wherein said vertical supports further comprise:

said frame shields defining a gap capable of receiving at least part of said upstanding legs when the folding workstation is in a collapsed configuration.

4. A foldable workstation providing generally flat and horizontal work surfaces that may be collapsed to reduce the size of the foldable workstation as set forth in claim 1, further comprising:

said upper shelf held in place in an extended configuration by a support.

5. A foldable workstation providing generally flat and horizontal work surfaces that may be collapsed to reduce the size of the foldable workstation as set forth in claim 4, further comprising:

said upper shelf held in place in an extended configuration by a pin passing through one of said vertical supports.

6. A foldable workstation providing generally flat and horizontal work surfaces that may be collapsed to reduce the size of the foldable workstation as set forth in claim 1, further comprising:

said middle shelf having a top reinforced by supports underlying said top so that said middle shelf may bear more weight.

7. A foldable workstation providing generally flat and horizontal work surfaces that may be collapsed to reduce the size of the foldable workstation as set forth in claim 1, further comprising:

said upstanding legs held in place in a collapsed configuration by a support.

8. A foldable workstation providing generally flat and horizontal work surfaces that may be collapsed to reduce the size of the foldable workstation as set forth in claim 7, further comprising:

said upstanding legs held in place in a collapsed configuration by a pin passing through one of said vertical supports.

9. A foldable workstation providing generally flat and horizontal work surfaces that may be collapsed to reduce the size of the foldable workstation as set forth in claim 1, further comprising:

said upper, middle, and lower shelves all having sterilizable surfaces to provide clean working surfaces.

10. A foldable workstation providing generally flat and horizontal work surfaces that may be collapsed to reduce the size of the foldable workstation as set forth in claim 9, further comprising:

aid upper, middle, and lower shelves all constructed of sterilizable material to provide clean working surfaces.

11. A foldable workstation providing generally flat and horizontal work surfaces that may be collapsed to reduce the size of the foldable workstation as set forth in claim 9, further comprising:

said upper, middle, and lower shelves all constructed of stainless steel to provide sterilizable working surfaces.

12. A foldable workstation providing generally flat and horizontal work surfaces that may be collapsed to reduce the size of the foldable workstation as set forth in claim 1, further comprising:

the folding workstation constructed of sterilizable material to provide clean working surfaces.

13. A foldable workstation providing generally flat and horizontal work surfaces that may be collapsed to reduce the size of the foldable workstation as set forth in claim 12, further comprising:

the folding workstation constructed of stainless steel to provide sterilizable working surfaces.

14. A foldable workstation providing generally flat and horizontal work surfaces that may be collapsed to reduce the size of the foldable workstation, comprising:

a pair of oppositely opposed vertical supports in spaced-apart relation;

an upper shelf pivotally coupled to said vertical supports, said upper shelf held in place in an extended configuration by a pin passing through one of said vertical supports;

a middle shelf pivotally coupled to said vertical supports at a rear end of said middle shelf, said middle shelf having a top reinforced by supports underlying said top so that said middle shelf may bear more weight;

a lower shelf pivotally coupled to said vertical supports at a rear end of said lower shelf;

said upper, middle and lower shelves all constructed of stainless steel to provide sterilizable working surfaces;

a pair of upstanding legs pivotally coupled to said middle and lower shelves at front ends of said middle and lower shelves, said upstanding legs held in place in a collapsed configuration by a pin passing through one of said vertical supports;

said middle shelf positionable between said upper shelf and lower;

said lower shelf extending away from said vertical supports a distance less than that of said middle shelf to accommodate a person's feet and shins;

said lower shelf coupled to said pair of upstanding legs by a pair of oppositely opposed and spaced apart lateral supports coupled to said lower shelf on opposite sides thereof, said lateral supports pivotally coupled to said upstanding legs and pivotally coupled to said vertical supports;

said upper shelf extending away from said vertical supports a distance less than that of said middle shelf to accommodate a person's arms and shoulders; and said vertical supports in the form of upstanding frame shields that support and protect said upper, middle, and lower shelves when said shelves are in a collapsed configuration, said frame shields defining a gap capable of receiving at least part of said upstanding legs when the folding workstation is in a collapsed configuration; and whereby the folding workstation provides collapsible work and storage surfaces that accommodate a person's anatomy and allows a person to perform tasks using the folding workstation with reduced interference and obstruction.

15. A foldable workstation providing generally flat and horizontal work surfaces that may be collapsed to reduce the size of the foldable workstation, comprising:

a pair of oppositely opposed vertical supports in spaced-apart relation;

an upper shelf pivotally coupled to said vertical supports;

a middle shelf pivotally coupled to said vertical supports at a rear end of said middle shelf;

a lower shelf pivotally coupled to said vertical supports at a rear end of said lower shelf;

a pair of upstanding legs pivotally coupled to said middle and lower shelves at front ends of said middle and lower shelves, said upstanding legs held in place in a collapsed configuration by a support and said upstanding legs held in place in a collapsed configuration by a pin passing through one of said vertical supports;

said middle shelf positionable between said upper shelf and lower shelf;

said lower shelf extending away from said vertical supports a distance less than that of said middle shelf to accommodate a person's feet and shins;

said upper shelf extending away from said vertical supports a distance less than that of said middle shelf to accommodate a person's arms and shoulders; and whereby the folding workstation provides collapsible work and storage surfaces that accommodate a person's anatomy and allows a person to perform tasks using the folding workstation with reduced interference and obstruction.

* * * * *